US005332096A

United States Patent [19]

Battaglia

[11] Patent Number: 5,332,096

[45] Date of Patent: Jul. 26, 1994

[54] MOUTHWASH CAPSULE AND PACKAGE APPARATUS

[76] Inventor: Anna D. Battaglia, 14 Bergen Trail, Hopatcong, N.J. 07843

[21] Appl. No.: 75,403

[22] Filed: Jun. 14, 1993

[51] Int. Cl.[5] ..... B65D 83/04

[52] U.S. Cl. ..... 206/532; 206/528; 221/30; 221/88; 225/67; 225/71

[58] Field of Search ..... 206/528, 532, 534.1, 206/538, 539; 220/284; 225/67, 71; 221/5, 30, 88

[56] References Cited

U.S. PATENT DOCUMENTS

| | | | |
|---|---|---|---|
| 3,772,431 | 11/1973 | Mlkvy et al. | 424/44 |
| 3,888,976 | 6/1975 | Mlkvy et al. | 424/44 |
| 4,074,806 | 2/1978 | Ardito | 206/539 |
| 4,442,085 | 4/1984 | Colman et al. | 424/49 |
| 4,532,126 | 7/1985 | Ebert et al. | 424/48 |
| 4,574,954 | 3/1986 | Reid | 206/532 |
| 4,765,984 | 8/1988 | Vellekoop et al. | 424/441 |
| 4,905,866 | 3/1990 | Bartell et al. | 206/539 |
| 4,971,785 | 11/1990 | Wilson et al. | 424/44 |
| 5,002,189 | 3/1991 | Sahi | 206/633 |
| 5,019,125 | 5/1991 | Rebne et al. | 206/538 |
| 5,038,968 | 8/1991 | Albetski | 221/88 |
| 5,109,984 | 5/1992 | Romick | 206/532 |
| 5,244,091 | 9/1993 | Tannenbaum | 206/532 |

*Primary Examiner*—David T. Fidei

*Attorney, Agent, or Firm*—E. Michael Combs

[57] ABSTRACT

A mouthwash capsule includes a water soluble gel capsule having a fluid mouthwash therewithin. The invention is arranged to further include packaging and opening structure in association with the capsule structure. The opening structure includes a floor plate having spaced side walls to receive the packaging with a sliding cutter mounted to the side wails in operative association with the packaging to separate the capsule relative to the packaging.

2 Claims, 4 Drawing Sheets

FIG. 3
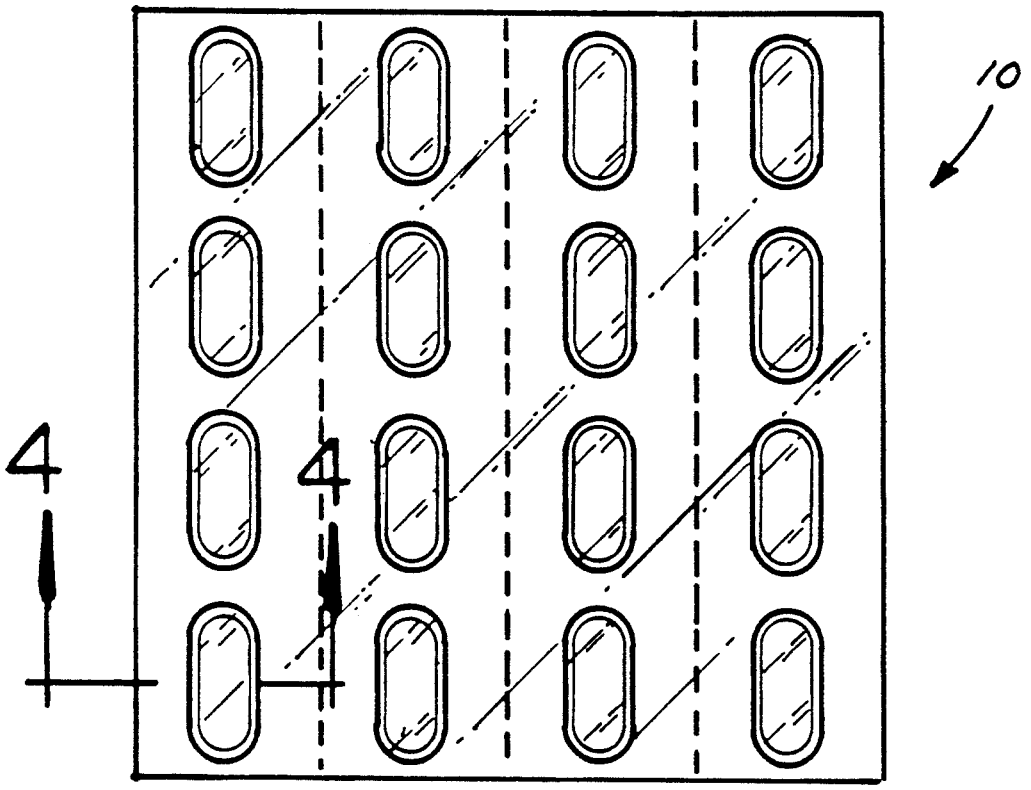
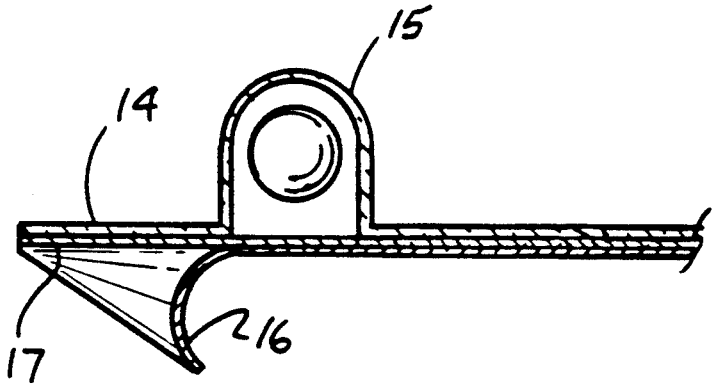
FIG. 4

MOUTHWASH CAPSULE AND PACKAGE APPARATUS

BACKGROUND OF THE INVENTION

1. Field of the Invention

The field of invention relates to mouthwash capsules, and more particularly pertains to a new and improved mouthwash capsule and package apparatus arranged for the containerization of fluid mouthwash therewithin.

2. Description of the Prior Art

Mouthwash capsule structure and tablets therefore have been utilized in the prior art as indicated in U.S. Pat. Nos. 3,888,976; 3,772,431; and 3,602,398.

The instant invention attempts to overcome deficiencies of the prior art by providing capsule structure permitting ease of dispensing and utilization of mouthwash therewithin.

SUMMARY OF THE INVENTION

In view of the foregoing disadvantages inherent in the known types of capsule structure now present in the prior art, the present invention provides a mouthwash capsule and package apparatus wherein the same is directed for the containing and dispensing of mouthwash therefrom. As such, the general purpose of the present invention, which will be described subsequently in greater detail, is to provide a new and improved mouthwash capsule and package apparatus which has all the advantages of the prior art mouthwash dispensing structure and none of the disadvantages.

To attain this, the present invention provides a mouthwash capsule including a water soluble gel capsule having a fluid mouthwash therewithin. The invention is arranged to further include packaging and opening means in association with the capsule structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mouthwash capsule and package apparatus which has all the advantages of the prior art mouthwash dispensing structure and none of the disadvantages.

It is another object of the present invention to provide a new and improved mouthwash capsule and package apparatus which may be easily and efficiently manufactured and marketed.

It is a further object of the present invention to provide a new and improved mouthwash capsule and package apparatus which is of a durable and reliable construction.

An even further object of the present invention is to provide a new and improved mouthwash capsule and package apparatus which is susceptible of a low cost of manufacture with regard to both materials and labor, and which accordingly is then susceptible of low prices of sale to the consuming public, thereby making such mouthwash capsule and package apparatus economically available to the buying public.

Still yet another object of the present invention is to provide a new and improved mouthwash capsule and package apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic top view of a series of capsules upon a support strip structure.

FIG. 4 is an orthographic view, taken along the lines 4—4 of FIG. 3 in the direction indicated by the arrows.

DESCRIPTION OF THE PREFERRED EMBODIMENT

Figure 1:
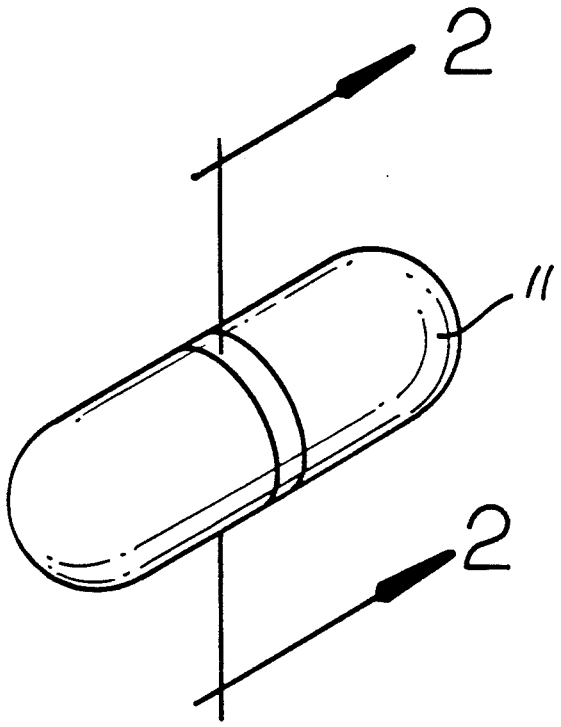
FIG. 1 is an isometric illustration of the capsule structure of the invention.
Figure 2:
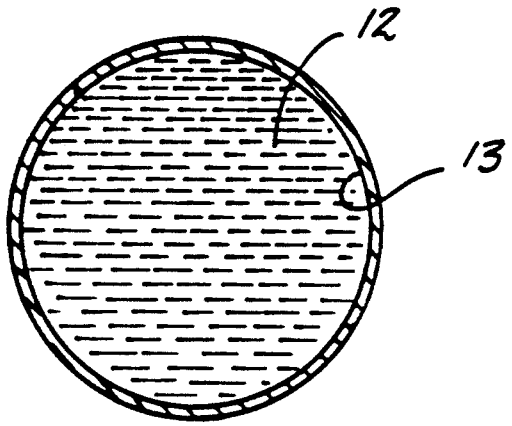
FIG. 2 is an orthographic view, taken along the lines 2—2 of FIG. 1 in the direction indicated by the arrows.

With reference now to the drawings, and in particular to FIGS. 1 to 8 thereof, a new and improved mouthwash capsule and package apparatus embodying the principles and concepts of the present invention and generally designated by the reference numeral 10 will be described.

More specifically, the mouthwash capsule and package apparatus 10 of the instant invention essentially comprises a water soluble gel capsule 11 having a capsule cavity 13 arranged to include a fluid or powdered mouthwash 12 therewithin. Such mouthwash may incorporate active ingredients, as indicated in the U.S. Pat. Nos. 3,888,976 or 3,772,431 incorporated herein by reference.

The FIG. 3 indicates the use of a plurality of strips integrated by a perforated member of individual package strips, wherein each package strip includes a transparent top layer 14 having a plurality of top layer pockets 15 arranged in a linear alignment relative to one another, with a peel-away bottom layer 16 of a fluid impermeable foil material mounted to an intermediate layer 17. The intermediate layer 17 is rupturable upon projection of the capsule therethrough upon removal of the peel-away bottom layer 16.

Figure 5:
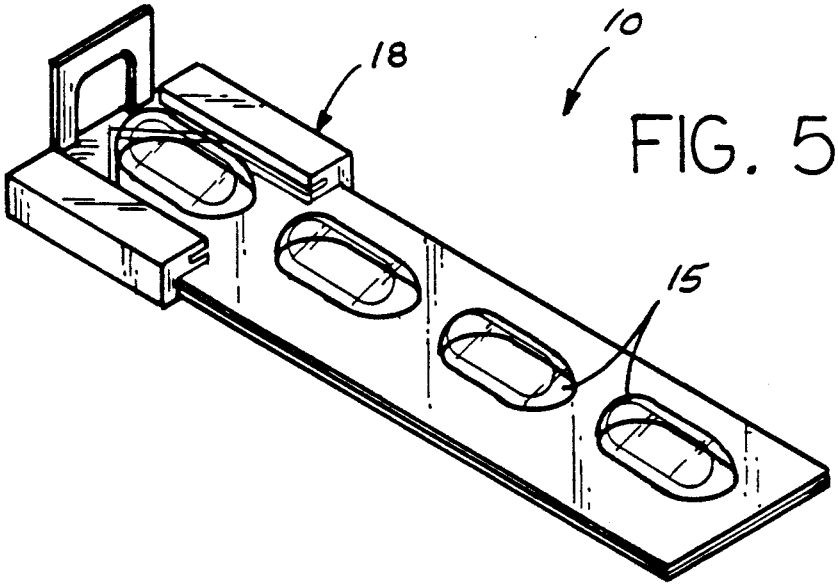
FIG. 5 is an isometric illustration of the invention including a capsule severing member.
Figure 6:
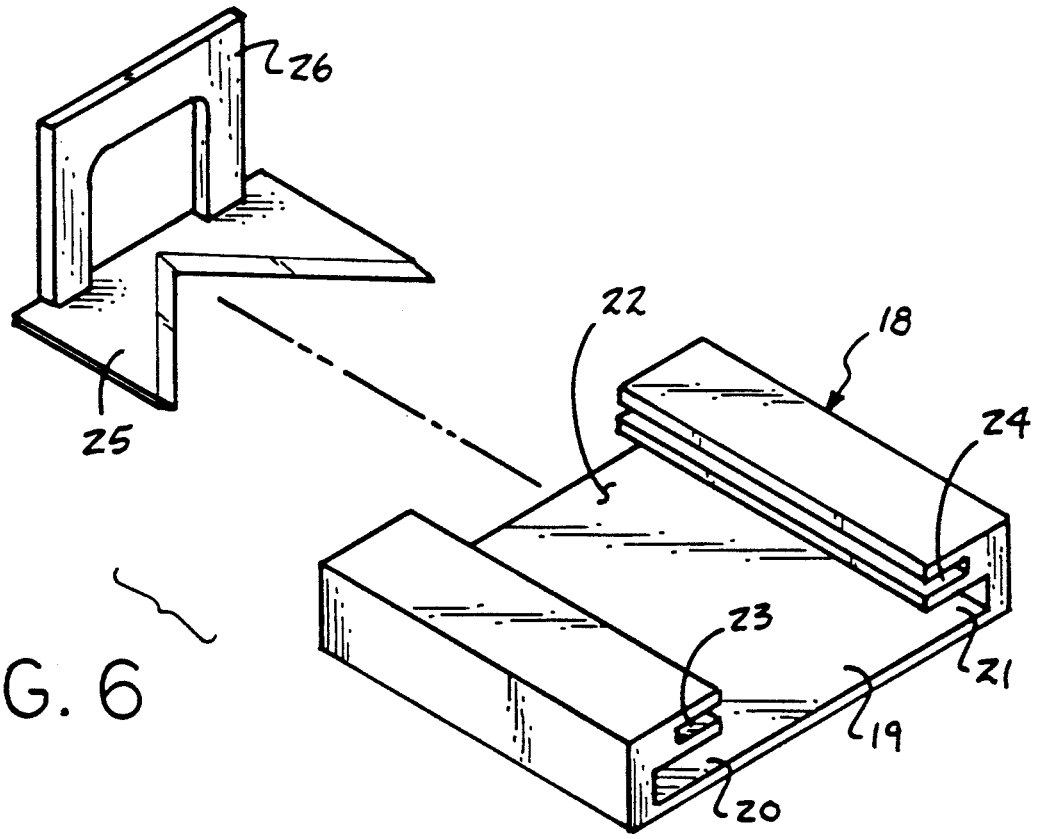
FIG. 6 is an isometric view of the capsule severing structure.
Figure 7:
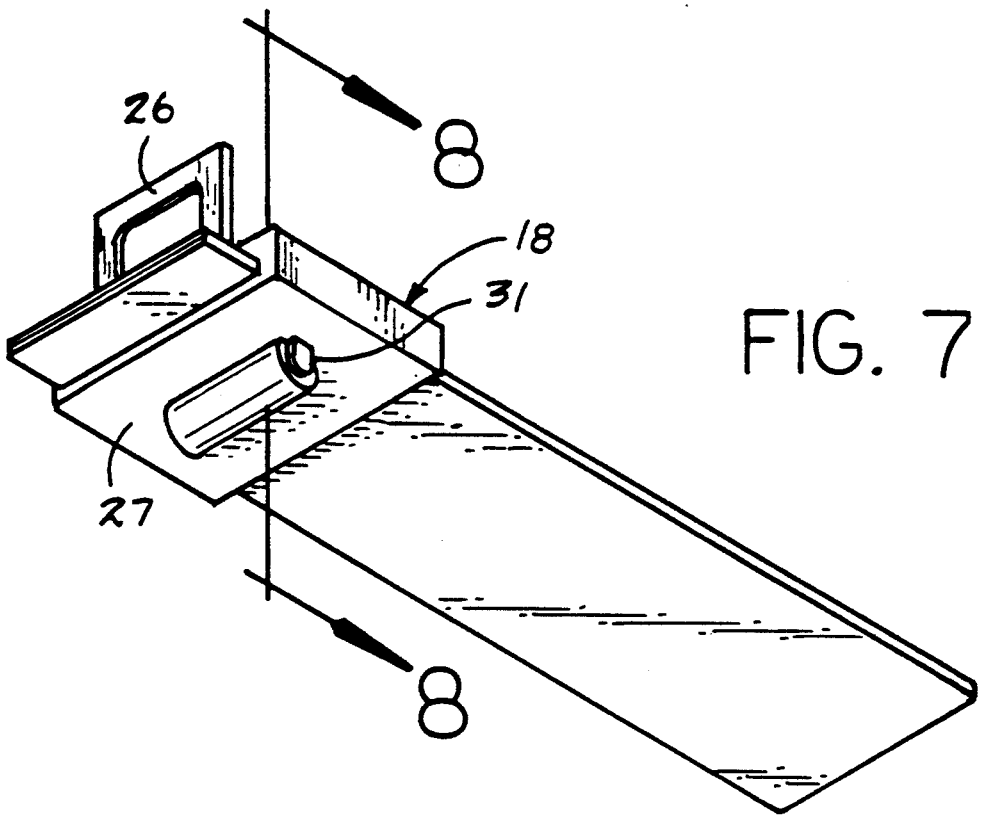
FIG. 7 is an isometric bottom view of the capsule severing structure in association with the capsule package.
Figure 8:
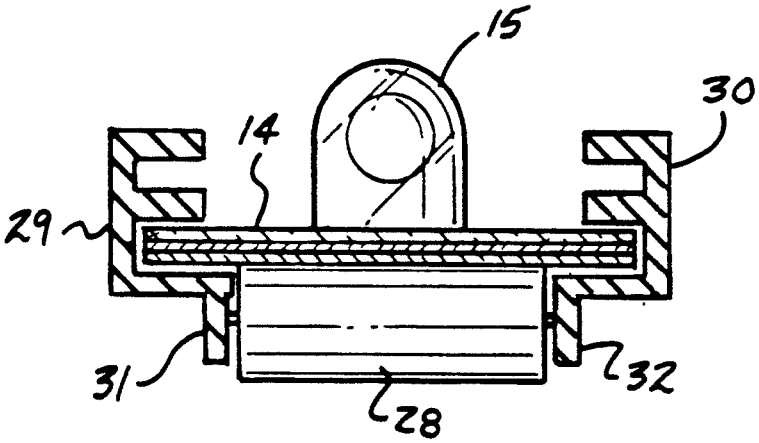
FIG. 8 is an orthographic view, taken along the lines 8—8 of FIG. 7 in the direction indicated by the arrows.

The FIG. 5 indicates the apparatus to include a cutting assembly 18 having a floor plate 19, including first and second slots 20 and 21 in contiguous communication with the floor plate 19, with the first and second slots 20 and 21 parallel and coextensive relative to one another defining a gap 22 therebetween to receive the package strip therethrough orienting each of the pockets 15 medially of the gap 22. Third and fourth slots 23 and 24 coextensive with the respective first and second slots 20 and 21 are oriented in a facing relationship relative to one another in a coplanar relationship to receive a cutter blade 25 within the third and fourth slots 23 and 24. The cutter blade 25 includes a cutter blade handle 26 fixedly mounted to the cutter blade 25 such that positioning of the pockets 15 permits orientation of each pocket in confronting relationship relative to the V-shaped cutter blade 25 for severing of the pockets for access to the capsule therewithin. The floor plate 19 includes a floor bottom surface 27 arranged to include a roller 28 orthogonally oriented between the first and second side walls 29 and 30 of the cutting assembly 18, with the first side wall 29 containing the first and third slots 23 and the second side wall 30 containing the second and fourth slots 21 and 24. The roller permits ease of directing the cutter assembly 18 towards individual pockets of the package strip upon the roller repositioned upon an underlying support surface (not shown), with the roller 28 rotatably mounted between first and second roller flanges 31 and 32 respectively orthogonally mounted to the floor bottom surface 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A mouthwash, capsule, and package apparatus, comprising, a package having at least one transparent top layer, the top layer including a top layer pocket, the pocket including a water soluble gel capsule having a capsule cavity, with the capsule cavity including a mouthwash therewith, and the apparatus further includes a cutting assembly, the cutting assembly including a floor plate, the floor plate having a first side wall spaced from and parallel a second side wall, with the first side wall and the second side wall spaced in a parallel relationship relative to one another, and the first side wall having a first slot in contiguous communication with a floor plate, the second side wall having a second slot in contiguous communication with the floor plate, the first slot and the second slot arranged in a parallel coextensive relationship relative to one another defining a gap therebetween, and a third slot superimposed upon the first slot spaced therefrom, and a fourth slot superimposed upon the second slot, wherein the third slot and the fourth slot are arranged in a coplanar relationship on opposed sides of said gap, and the pocket oriented within the gap, wherein the top layer is received within the first slot and the second slot, and a cutter blade received within the third slot and the fourth slot, the cutter blade including a cutter blade handle.

2. A mouthwash capsule, package, and apparatus as set forth in claim 1 wherein the floor plate includes a floor plate bottom surface, the floor plate bottom surface includes a first roller flange and a second roller flange arranged orthogonally relative to the floor bottom surface projecting therefrom, wherein the first roller flange is oriented in adjacency to the first side wall, and the second roller flange is positioned in adjacency relative to the second side wall, and a roller member rotatably mounted between the first roller flange and the second roller flange.

* * * * *